US007276319B2

(12) United States Patent
Hirose et al.

(10) Patent No.: US 7,276,319 B2
(45) Date of Patent: Oct. 2, 2007

(54) TONER FOR ELECTROSTATIC LATENT IMAGE DEVELOPMENT AND IMAGE FORMING METHOD

(75) Inventors: Naohiro Hirose, Hachioji (JP); Asao Matsushima, Hachioji (JP); Shiro Hirano, Hachioji (JP); Hiroshi Yamazaki, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 520 days.

(21) Appl. No.: 10/798,200

(22) Filed: Mar. 11, 2004

(65) Prior Publication Data

US 2005/0202331 A1 Sep. 15, 2005

(51) Int. Cl.
*G03G 9/09* (2006.01)

(52) U.S. Cl. ..... 430/108.23; 430/108.2; 430/109.3; 430/123.57

(58) Field of Classification Search ..... 430/108.2, 430/108.21, 109.3, 108.9, 111.4, 137.14, 430/108.23
See application file for complete search history.

(56) References Cited

U.S. PATENT DOCUMENTS 5,518,848 A * 5/1996 Ito et al. ..... 430/96
6,335,135 B1 * 1/2002 Arai et al. ..... 430/108.6
2002/0058193 A1 * 5/2002 Tosaka et al. ..... 430/108.23
2002/0192582 A1 * 12/2002 Yamazaki et al. ..... 430/100

FOREIGN PATENT DOCUMENTS

| | | |
|---|---|---|
| JP | 10-288863 | 10/1998 |
| JP | 10-307427 | 11/1998 |
| JP | 11-295930 | 10/1999 |
| JP | 2000-352845 | 12/2000 |
| JP | 2001-175030 | 6/2001 |
| JP | 2003-149869 | 5/2003 |

OTHER PUBLICATIONS

Japanese Patent Office machine-assisted translation of JP 10-288863 (pub. Oct. 27, 1998).*
American Chemical Society (ACS) File Registry No. 6358-31-2, entered STN on Nov. 16, 1984, ACS on STN, copyright 2007.*

* cited by examiner

*Primary Examiner*—Janis L. Dote
(74) *Attorney, Agent, or Firm*—Lucas & Mercanti, LLP

(57) ABSTRACT

A toner for electrostatic latent image development includes a coloring agent and a resin wherein the toner is formed by a polymerization method and a content of aromatic amine contained in the toner is 50 ppm or less, and a volume average particle size of the toner is 3 to 8 μm; and an image forming method employs the same toner.

18 Claims, 2 Drawing Sheets

TONER FOR ELECTROSTATIC LATENT IMAGE DEVELOPMENT AND IMAGE FORMING METHOD

BACKGROUND

1. Field of the Invention

The present invention relates to toner for electrostatic latent image development used for printers, copying machines, facsimiles and the like, and an image forming method using the same.

2. Description of Related Art

Nowadays, a method for developing an electrostatic latent image development as typified by electrophotography is widely used for methods for forming images in printers, copying machines and facsimiles.

This is because it is a high-quality finished method where high-quality images with high speed are stably given, but some problems still remain. In the toner for electrostatic latent image development (hereinafter, also simply referred to as the toner), it is desired to reduce particle sizes and uniform the particle sizes with aiming to increase image quality. Recently, polymerization toners have been actively developed as methods for manufacturing such toners with small size where a volume average particle size is about 3 to 8 μm.

The toner obtained by polymerization method is obtained by a method for making resin particles by polymerizing a radical polymerizable monomer in an aqueous vehicle and making the toner without taking step of pulverizing and subsequently classifying. As the methods for making this polymerization toner, there are the method for preparing toner in an uneven shape by associating or salting out/fusing resin particles and coloring agent particles, and the method where a radical polymerizable monomer and a coloring agent are mixed, then dispersed as liquid droplets in an aqueous vehicle to become the desired toner particle size and suspension polymerization is performed.

In these, the method for preparing the toner in an uneven shape by associating or salting out/fusing the resin particles and the coloring agent particles is the preferable method as the method for forming the toner in an uneven shape.

Whereas, in the study by the present inventors, it have been found that toner off-set sometime occurs, when the polymerization toner is used for especially a contact type heat fixing unit, if used for a long term.

SUMMARY

A toner for electrostatic latent image development comprises a coloring agent and a resin, wherein the toner is formed by a polymerization method and a content of aromatic amine contained in the toner is 50 ppm or less, and a volume average particle size of the toner is 3 to 8 μm.

A toner for electrostatic latent image development comprises a coloring agent and a resin, wherein the toner is formed by polymerization of radical-polymerizable monomer in aqueous vehicle and a content of aromatic amine contained in the toner is 50 ppm or less.

An image forming method comprises developing an electrostatic latent image formed on an image bearing member by using either of the above toners.

According to the above toners and image forming method using those, it become possible to provide toner of so-called polymerization toner for electrostatic latent image development where there is no stain of a fixing unit even when used in a contact type heat fixing over a long term and which can form stable images over a long term, and a image forming method using the same.

BRIEF DESCRIPTION OF THE DRAWINGS

The present invention will become more fully understood from the detailed description given hereinbelow and the appended drawings. However, they are not intended as a definition of the limits of the present invention, and wherein.

DETAILED DESCRIPTION OF THE PREFERRED EMBODIMENTS

Figure 1:
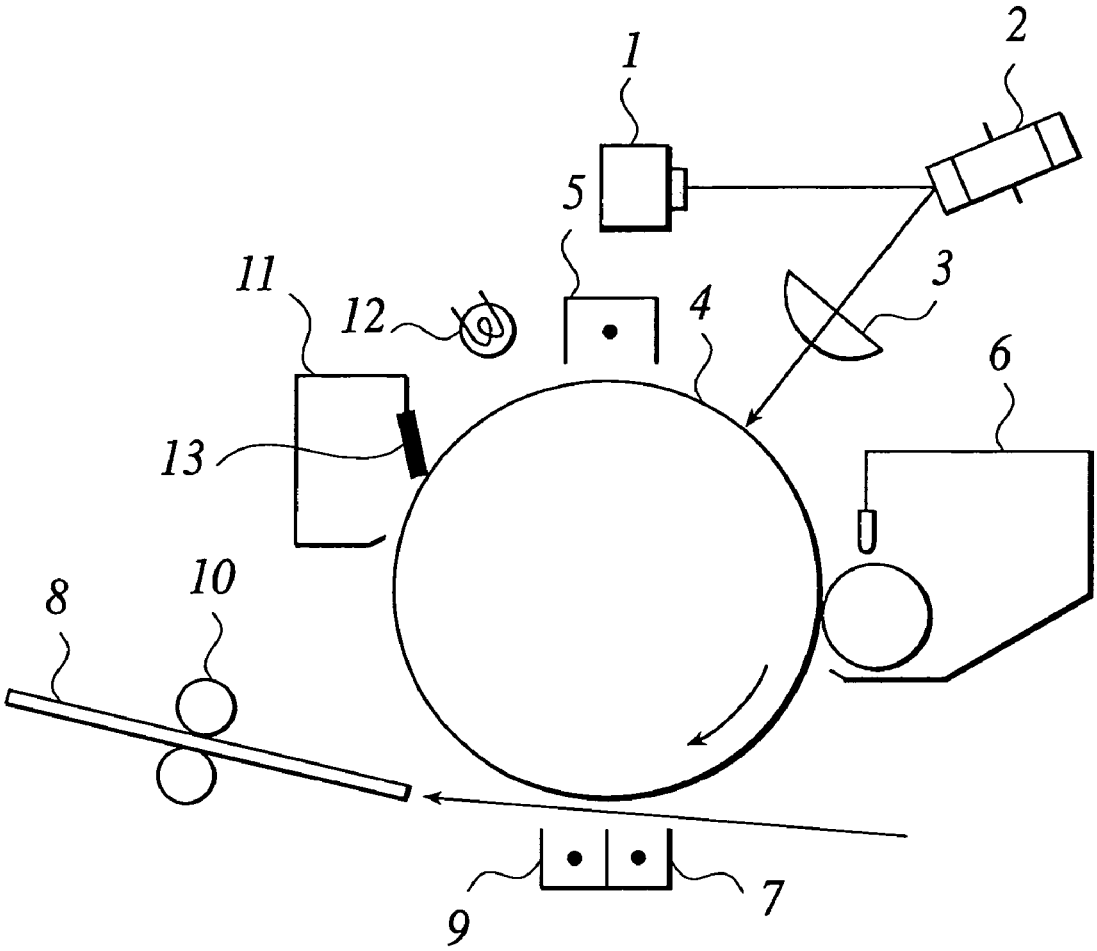
FIG. 1 is a sectional block diagram showing one example of the image forming apparatus applied in the invention.

As a result of intensive study, the present inventors have found that stain with the polymerization toner at the contact type fixing unit occurs due to electrostatic adhesion to the fixing unit.

As the result of further detailed analysis, it has been estimated as this cause that electrostatic adhesiveness is changed due to adhesion of an amine component contained a trace amount in the toner to the fixing unit to make the toner adhere electrostatically. Especially, the inventors have found that aromatic amine among the amine component remarkably influences it, and have developed into the invention.

The contact type fixing unit employs a mode where a heating source such as a heating roller directly contacts an unfixed toner image and melting/fixing is performed by heating the toner.

Typically, the surface of the heating roller and heating film of the contact type heat fixing unit is coated with a fluorine system resin to suppress adhesion of the toner and the like. This fluorine type resin itself has a strong negative charging property, and the aromatic amine easily adheres to the surface because of having a positive charging property. As a result, it has been estimated that portions of the heating roller and the heating film which contact the toner become positively charging, in particular, the negatively charging toner easily adheres electrostatically, and thus the toner easily cause the off-sets.

When a content of this aromatic amine component exceeds 50 ppm in the toner, the stain at the fixing unit becomes remarkable and the stain at the fixing unit is caused. But, as described below, it has been found that the aromatic amine is typically contained as an impurity in the coloring agent to some extent, and thus the content thereof in the toner exceeds the above range, which causes the problem in the polymerization toner.

That is, in pulverization toner used in earlier technology, the toner is made by dissolving/kneading the resin and the coloring agent followed by pulverizing/classifying. In this step, the resin is heated to not less than a melting temperature and simultaneously a great shear is given by a kneading apparatus such as biaxial extruder. Thus, since the resin is heated to not less than a softening point of the resin in this step, aromatic amine present in the resin is vaporized with this heat and scarcely can exist as a simple substance in the eventual toner.

On the other hand, in the so-called polymerization toner, there is no melting/kneading step as the above, when prepared by radical polymerization, heating is maximally up to about 100° C. which is a boiling point of water. As a result, it has been estimated that the aromatic amine remains at a trace amount and the problem as the above occurs at fixing.

Compounds, constituents, methods for manufacturing and methods for forming images and the like according to the invention are illustrated below.

Aromatic amine components regarded as a problem in the invention include a compound represented by the following formula.

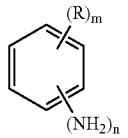

$2 \leq m + n \leq 6$

Wherein R is a hydrogen atom, a chlorine atom, a bromine atom, a nitro group, an alkyl group with 1 to 6 and 8 carbons, an alkoxy group with 1 to 6 and 8 carbons, or —NHCOR' where R' is an alkyl group with 1 to 6 and 8 carbons. As specific compounds, o-anisidine and the like can be given.

These aromatic amine compounds are often contaminated in the toner as impurities present in carbon black and as impurities present in various coloring agents (color materials). Thus, to make the content in the toner 50 ppm or less at a mass ratio as the invention, it is preferable to use the material after eliminating the aromatic amine compounds which are impurities present in basic materials.

This method is not especially limited, and can include, for example, the method for treating the coloring agent with heat in an inert gas (heating to about 150 to 300° C.), the method for heating the coloring agent and deaerating it in vacuum (drying under reduced pressure), the method for making a master batch from the coloring agent and the resin, and the like.

The content of aromatic amine in the coloring agent is reduced by these methods to use. Quantification of the aromatic amine compound can be performed using head-space gas chromatography, and identification of the compound itself can be confirmed by mass spectrum. When multiple types of aromatic amine are present, a total sum could be 50 ppm or less. In any case, in the invention the more preferable range is 30 ppm or less, and further it is preferable to be 10 ppm or less.

The content (proportion) of aromatic amine is represented by mass of aromatic amine divided by mass of toner.

Next, the method for manufacturing the toner of the invention is illustrated. The toner of the invention can be manufactured by the suspension polymerization method performed in aqueous vehicle or a method in which emulsion polymerization of a monomer in a liquid to which an emulsion of required additives is added is performed to manufacture fine resin particles and subsequently an organic solvent, a coagulant and the like are added to perform aggregation and fusion. The method for preparing by mixing and associating with a dispersion solution of a release agent, a coloring agent and the like required for the configuration of toner upon the aggregation and fusion, the methods where toner constituents such as the release agent and coloring agent are dispersed in a monomer followed by performing the emulsion polymerization, and the like are included. Here, the association indicates that the multiple numbers of the resin particles and the coloring agent particles are fused.

An aqueous vehicle in the invention indicates one in which water is contained at least 50% or more by mass.

That is, in the suspension polymerization, various constituents such as the coloring agent and if necessary, the release agent, a charge control agent, further a polymerization initiator are added into the polymerizable monomer, and the various constituents are dissolved or dispersed in the polymerizable monomer using a homogenizer, a sand mill, a sand grinder, an ultrasonic dispersing machine and the like. The polymerizable monomer in which these various constituents are dissolved or dispersed is dispersed in the aqueous vehicle containing a dispersion stabilizer by making it into oil droplets with desired size as the toner by using a homo mixer, a homogenizer and the like. Subsequently, the polymerization reaction is carried forward by heating. After the termination of reaction, the coloring agent particles are made by eliminating the dispersion stabilizer, filtrating, washing and further drying, and the toner of the invention is prepared by adding external additives if necessary.

As the method for manufacturing the toner of the invention, it is also possible to include the method for preparing by agglutinating and fusing the resin particles made by the emulsion polymerization in the aqueous vehicle. This method is not especially limited, and can include, for example, the methods shown in JP-Hei 5-265252A, JP-Hei 6-329947A and JP-Hei 9-15904A. That is, the toner of the invention can be formed by the method for associating multiple numbers of dispersion particles of the constituents such as resin particles and coloring agent or fine particles composed of the resin, the coloring agent and the like, in particular by dispersing them in water using an emulsifier, subsequently salting out by adding a coagulant at not less than a critical aggregation concentration and simultaneously heating/fusing at not less than a glass transition temperature of the formed polymer itself to form resin particles and make particle sizes gradually grow, stopping particle size growth by adding a large amount of water at the time point when an aimed particle size is obtained, further making particle surfaces smooth with heating and stirring to control the shape, and heating/drying those particles in a fluid condition with a hydrous condition. Here, an organic solvent which infinitely dissolves in water may be added concurrently with the coagulant.

Those used as the polymerizable monomer which composes the resin are styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene; p-n-nonylstyrene, p-n-decylstyrene and p-n-dodecylstyrene, methacrylate ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; acrylate ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; olefins such as ethylene, propylene and isobutylene; halogen type vinyls such as vinyl chloride, vinylidene chloride, vinyl bromide, vinyl fluoride and vinylidene fluoride; vinyl esters such as vinyl propionate, vinyl acetate and vinyl benzoate; vinyl ethers such as vinylmethylether and vinylethylether; vinyl ketones such as vinylmethylketone, vinylethylketone and vinylhexylketone; N-vinyl compounds such as N-vinylcarbazole, N-vinylindole and N-vinylpyrrolidone; vinyl compounds such as vinylnaphthalene and vinylpyridine; and acrylic acid or methacrylic acid derivatives such as acrylonitrile, methacrylonitrile and acrylamide. These vinyl type monomers can be used alone or in combination.

As the polymerizable monomer which composes the resin, it is more preferable to use one having ionic leaving group in combination. For example, they are those having substituents such as carboxylic group, sulfonic group and phosphoric group as composing groups of the monomer, and specifically, acrylic acid, methacrylic acid, maleic acid, itaconic acid, cinnamic acid, fumaric acid, monoalkyl maleate ester, monoalkyl itanonate ester, styrene sulfonate, allyl sulfosuccinate, 2-acrylamide-2-methylpropane sulfonate, acid phosphoxyethyl methacrylate, and 3-chloro-2-acid phosphoxypropyl methacrylate are included.

Additionally, it is also possible to make the resin of crosslinking structure by using multifunctional vinyls such as divinylbenzene, ethyleneglycol dimethacrylate, ethyleneglycol diacrylate, diethyleneglycol dimethacrylate, diethyleneglycol diacrylate, triethyleneglycol dimethacrylate, triethyleneglycol diacrylate, neopentylglycol dimethacrylate and neopentylglycol diacrylate.

In order to promote the polymerization reaction, it is preferable to use a water-soluble radical polymerization initiator. The water-soluble radical polymerization initiator can include persulfate salts such as potassium persulfate and ammonium persulfate, azobisaminodipropane acetate salts, azobiscyano valeric acid and salts thereof, hydrogen peroxide and the like.

Furthermore, to regulate a molecular weight of the polymerized resin, it is also possible to use a chain transfer agent. For example, $$HS—R^1—COOR^2 \qquad \text{General formula (1)}$$

Wherein $R^1$ represents a hydrocarbon group with 1 to 10 carbons which may have substituents, and $R^2$ represents a hydrocarbon group with 2 to 20 carbons which may have substituents.

As those which are preferable, it is possible to include thioglycolate esters and 3-mercaptopropionate esters. Specifically, as thioglycolate esters, it can include ethyl thioglycolate, butyl thioglycolate, t-butyl thioglycolate, 2-ethylhexyl thioglycolate, octyl thioglycolate, isooctyl thioglycolate, decyl thioglycolate, dodecyl thioglycolate, thioglycolate ester of ethyleneglycol, thioglycolate ester of neopentylglycol, thioglycolate ester of trimethylolpropane, thioglycolate ester of pentaerythritol and thioglycolate ester of sorbitol, and as 3-mercaptopropionate esters, it can include ethyl ester, octyl ester, decyl ester, dodecyl ester, pentaerythritoltetrakis ester, 3-mercaptopropionate ester of ethyleneglycol, 3-mercaptopropionate ester of neopentylglycol, 3-mercaptopropionate ester of trimethylolpropane, 3-mercaptopropionate ester of pentaerythritol and 3-mercaptopropionate ester of sorbitol.

Also, the compounds represented by the following general formula (2) can be preferably used.

$$HS—R^3 \qquad \text{General formula (2)}$$

Wherein $R^3$ is a hydrocarbon group with 1 to 20 carbons which may have substituents.

The compounds represented by the general formula (2) can include n-octyl mercaptan, 2-ethylhexyl mercaptan, n-dodecyl mercaptan, sec-dodecyl mercaptan, t-dodecyl mercaptan or the like.

Content for any compound is preferably from 0.01 to 5% by mass.

As a degree of polymerization of the resin used for the invention, the resin which contains both a high molecular weight component having a peak or a shoulder at the range of 100,000 to 1,000,000 and a low molecular weight component having a peak or a shoulder at the range of 1,000 to less than 20,000 is preferable. Moreover, for the molecular weights of the whole resin, a number average molecular weight (Mn) is preferably from 1,000 to 100,000 and a weight average molecular weight (Mw) is preferably from 2,000 to 1,000,000. Furthermore, as a molecular weight distribution, Mw/Mn is from 1.5 to 100 and in particular preferably from 1.8 to 70.

The method for measuring the molecular weight of the resin can include, for example, a measurement method by GPC (gel permeation chromatography) using THF (tetrahydrofuran) as a solvent.

That is, THF is added to 0.5 to 5 mg of measurement sample, more specifically 1 ml of THF is added with respect to 1 mg of the sample, and stirred using a magnetic stirrer to dissolve thoroughly. Then, the sample is filtrated with a membrane filter having a pore size of 0.45 to 5.0 μm and subsequently injected into GPC. As a measurement condition, a column is stabilized at 40° C., THF is run at a flow rate of 1 ml/min, and about 100 μl of the sample at a concentration of 1 mg/ml is injected to measure. It is preferable to use commercially available polystyrene gel columns in combination.

For example, the combinations of Shodex GPC KF-801, 802, 803, 804, 805, 806 and 807 supplied from Showa Denko K.K. and the combinations of TSK Gel G1000H, G2000H, G3000H, G4000H, G5000H, G6000H, G7000H and TSK guard column supplied from Tosoh Corporation, and the like can be included. As a detector, an index of refractive detector (IR detector) or a UV detector as a detector could be used. In the molecular weight measurement of the sample, the molecular weight distribution which the sample has is calculated using a calibration curve measured using monodisperse polystyrene standard particles. About 10 kinds of polystyrene are preferably used for the calibration curve measurement.

As the excellent resin in the invention, those where a glass transition temperature is from 20 to 90° C. are preferable, and those where a softening point is from 80 to 220° C. are preferable. The glass transition temperature is measured by differential calorimetry analysis, and the softening point can be measured by an elevated flow tester.

The coagulant used is not especially limited, and those selected from metal salts are suitably used. Specifically, for example, salts of alkali metals such as sodium, potassium and lithium as monovalent metals, salts of alkali earth metals such as calcium and magnesium as bivalent metals, salts of bivalent metals such as manganese and copper, and salts of trivalent metals such as iron and aluminium, and the like are included. Specific salts can include sodium chloride, potassium chloride, lithium chloride, calcium chloride, zinc chloride, copper sulfate, magnesium sulfate, manganese sulfate and the like. These may be used in combination.

It is preferred that these coagulants are added at the content not less than a critical aggregation concentration. This critical aggregation concentration is an index for stability of an aqueous dispersion and indicates a concentration where aggregation occurs by adding the coagulant. This critical aggregation concentration greatly varies depending on emulsified components and a dispersant itself. It is described in, for example, "Kobunshi Kagaku 17, 601 (1960) written by Seizo Okamura et al., edited by the Society of Polymer Science. Japan" and the like, and the detailed critical aggregation concentration can be calculated. As another technique, the desired salt with varying concentrations is added to an aimed particle dispersion solution, ζ (zeta) potential of the dispersion solution is measured, and a salt concentration at which this value is changed can be regarded as made the critical aggregation concentration.

The addition amount of the coagulant of the invention could be not less than the critical aggregation concentration, but preferably 1.2 times or more, and more preferably 1.5 times or more of the critical aggregation concentration.

An infinitely dissolving solvent indicates a solvent which infinitely dissolves in water, and as this solvent, those which does not dissolve the formed resin are selected in the invention. Specifically, it is possible to include alcohols such as methanol, ethanol, propanol, isopropanol, t-butanol, methoxyethanol and butoxyethanol, nitriles such as acetonitrile, and ethers such as dioxane. Especially, ethanol, propanol and isopropanol are preferable. The addition amount of this infinitely dissolving solvent is preferably from 1 to 100% by volume based on a polymer-containing dispersion solution to which the coagulant has been added.

To make the shape uniform, after preparing and filtrating coloring particles, and it is preferable to fluidize/dry slurry where 10% or more by mass of water based on the particles is present, and at that time, those having polar group in the polymer are especially preferable. As the reason for it, it is believed that the water present exerts an effect of some swelling to the polymer where the polar group exists and thus the shape is easily made uniform.

The toner of the invention contains at least the resin and the coloring agent, but if necessary, it is also possible to contain a release agent, a charge control agent and the like which are fixing property improving agents. Moreover, external additives composed of inorganic fine particles, organic fine particles and the like may be added to the toner particles where major ingredients are the above resin and coloring agent.

As the coloring agents used for the toner of the invention, it is possible to optionally use carbon black, magnetic bodies, dyes, pigments, and the like. As the carbon black, channel black, furnace black, acetylene black, thermal black, lamp black, and the like are used. As the magnetic bodies, it is possible to use strong magnetic metals such as iron, nickel and cobalt, alloys including these metals, compounds of strong magnetic metals such as ferrite and magnetite, alloys which include no strong magnetic metal but exhibit strong magnetism by treating with heat, e.g., alloys of type called Heusler alloys such as manganese-copper-aluminium and manganese-copper-tin, chromium dioxide and the like.

As the dyes, it is possible to use C.I. solvent red 1, 49, 52, 58, 63, 111 and 122, C.I. solvent yellow 19, 44, 77, 79, 81, 82, 93, 98, 103, 104, 112 and 162, C.I. solvent blue 25, 36, 60, 70, 93 and 95, and the like, and mixtures thereof. As the pigments, it is possible to use C.I. pigment red 5, 48:1, 53:1, 57:1, 122, 139, 144, 149, 166, 177, 178 and 222, C.I. pigment orange 31 and 43, C.I. pigment yellow 14, 17, 93, 94, 138, 156, 158, 180 and 185, C.I. pigment green 7, C.I. pigment blue 15:3 and 60, and the like, and mixtures thereof. A number average primary particle size varies depending on types, but is preferably from about 10 to 200 nm.

As the method for adding the coloring agent, it is possible to use the method for coloring the polymer by adding at a stage when polymer particles prepared by the emulsion polymerization are aggregated by adding the coagulant, the method for making coloring particles by adding the coloring agent at a stage when the monomer is polymerized and polymerizing, and the like. When the coloring agent is added at the stage where the polymer is prepared, it is preferred that the coloring agent is used by treating the surface with a coupling agent and the like not to inhibit radical polymerization property.

If necessary, the release agent is added, and the structure of mold releasing agent is not especially limited. Low molecular weight polyolefin wax such as polypropylene and polyethylene, paraffin wax, Fisher-Tropsch wax, ester wax and the like can be used. Those especially suitably used include ester wax represented by the following general formula.

$$R_1—(OCO—R_2)_n$$

In the above general formula, n is an integer of 1 to 4, preferably 2 to 4, more preferably 3 to 4, and especially preferably 4.

$R_1$ and $R_2$ represent hydrocarbon groups which may have substituents. Here, the number of carbons in $R_1$ is from 1 to 40, preferably from 1 to 20, and more preferably from 2 to 5. The number of carbons in $R_2$ is from 1 to 40, preferably from 16 to 30, and more preferably from 18 to 26.

Next, examples of the representative compounds are shown below.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6)

$$CH_3—(CH_2)_{20}—COO—(CH_2)_2—\overset{\overset{CH_3}{|}}{CH}—CH_2—O—CO—(CH_2)_{20}—CH_3$$

7)

$$CH_3—(CH_2)_{22}—COO—(CH_2)_2—\overset{\overset{CH_3}{|}}{CH}—CH_2—O—CO—(CH_2)_{22}—CH_3$$

8)

$$CH_3—(CH_2)_{22}—COO—CH_2—\underset{\underset{CH_3}{|}}{\overset{\overset{CH_3}{|}}{C}}—CH_2—O—CO—(CH_2)_{22}—CH_3$$

9)

$$CH_3—(CH_2)_{26}—COO—CH_2—\underset{\underset{CH_3}{|}}{\overset{\overset{CH_3}{|}}{C}}—CH_2—O—CO—(CH_2)_{26}—CH_3$$

10)

$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

11)

$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

-continued

12)

$$\begin{array}{l} CH_2-OH \\ | \\ CH-O-CO-(CH_2)_{26}-CH_3 \\ | \\ CH_2-O-CO-(CH_2)_{26}-CH_3 \end{array}$$

13)

$$\begin{array}{l} CH_2-OH \\ | \\ CH-O-CO-(CH_2)_{22}-CH_3 \\ | \\ CH_2-O-CO-(CH_2)_{22}-CH_3 \end{array}$$

14)

$$\begin{array}{l} CH_2-OH \\ | \\ CH-OH \\ | \\ CH_2-O-CO-(CH_2)_{26}-CH_3 \end{array}$$

15)

$$\begin{array}{l} CH_2-OH \\ | \\ CH-OH \\ | \\ CH_2-O-CO-(CH_2)_{22}-CH_3 \end{array}$$

16)

$$\begin{array}{l} \qquad\qquad\qquad\qquad\qquad\qquad CH_3 \\ \qquad\qquad\qquad\qquad\qquad\qquad | \\ CH_3-(CH_2)_{26}-COO-CH_2-C-CH_2-O-CO-(CH_2)_{26}-CH_3 \\ \qquad\qquad\qquad\qquad\qquad\qquad | \\ \qquad\qquad\qquad\qquad\qquad\qquad CH_2-O-CO-(CH_2)_{26}-CH_3 \end{array}$$

17)

$$\begin{array}{l} \qquad\qquad\qquad\qquad\qquad\qquad CH_2CH_3 \\ \qquad\qquad\qquad\qquad\qquad\qquad | \\ CH_3-(CH_2)_{20}-COO-CH_2-C-CH_2-O-CO-(CH_2)_{20}-CH_3 \\ \qquad\qquad\qquad\qquad\qquad\qquad | \\ \qquad\qquad\qquad\qquad\qquad\qquad CH_2-O-CO-(CH_2)_{20}-CH_3 \end{array}$$

18)

$$\begin{array}{l} \qquad\qquad\qquad\qquad\qquad\qquad CH_2-O-CO-(CH_2)_{26}-CH_3 \\ \qquad\qquad\qquad\qquad\qquad\qquad | \\ CH_3-(CH_2)_{26}-COO-CH_2-C-CH_2-O-CO-(CH_2)_{26}-CH_3 \\ \qquad\qquad\qquad\qquad\qquad\qquad | \\ \qquad\qquad\qquad\qquad\qquad\qquad CH_2-O-CO-(CH_2)_{26}-CH_3 \end{array}$$

19)

$$\begin{array}{l} \qquad\qquad\qquad\qquad\qquad\qquad CH_2-O-CO-(CH_2)_{20}-CH_3 \\ \qquad\qquad\qquad\qquad\qquad\qquad | \\ CH_3-(CH_2)_{20}-COO-CH_2-C-CH_2-O-CO-(CH_2)_{20}-CH_3 \\ \qquad\qquad\qquad\qquad\qquad\qquad | \\ \qquad\qquad\qquad\qquad\qquad\qquad CH_2-O-CO-(CH_2)_{20}-CH_3 \end{array}$$

20)

$$\begin{array}{l} \qquad\qquad\qquad\qquad\qquad\qquad CH_2-O-CO-(CH_2)_{18}-CH_3 \\ \qquad\qquad\qquad\qquad\qquad\qquad | \\ CH_3-(CH_2)_{18}-COO-CH_2-C-CH_2-O-CO-(CH_2)_{18}-CH_3 \\ \qquad\qquad\qquad\qquad\qquad\qquad | \\ \qquad\qquad\qquad\qquad\qquad\qquad CH_2-O-CO-(CH_2)_{18}-CH_3 \end{array}$$

21)

$$\begin{array}{l} \qquad\qquad\qquad\qquad\qquad\qquad CH_2-O-CO-(CH_2)_{16}-CH_3 \\ \qquad\qquad\qquad\qquad\qquad\qquad | \\ CH_3-(CH_2)_{16}-COO-CH_2-C-CH_2-O-CO-(CH_2)_{16}-CH_3 \\ \qquad\qquad\qquad\qquad\qquad\qquad | \\ \qquad\qquad\qquad\qquad\qquad\qquad CH_2-O-CO-(CH_2)_{16}-CH_3 \end{array}$$

22)

$$\begin{array}{l} \qquad\qquad\qquad\qquad\qquad\qquad CH_2-O-CO-CH_3 \\ \qquad\qquad\qquad\qquad\qquad\qquad | \\ CH_3-(CH_2)_{20}-COO-CH_2-C-CH_2-O-CO-CH_3 \\ \qquad\qquad\qquad\qquad\qquad\qquad | \\ \qquad\qquad\qquad\qquad\qquad\qquad CH_2-O-CO-CH_3 \end{array}$$

The addition amount is preferably from 1 to 30%, and more preferably from 2 to 20% by mass based on the whole toner.

Also as the charge control agent, it is possible to use various ones known in the art and capable of being dispersed in water. Specifically, nigrosine type dyes, metal salts of naphthenic acid or higher fatty acids, alkoxylated amine, quaternary ammonium salt compounds, azo type metal complex, salicylate metal salts or metal complex thereof are included.

It is preferred that particles of these release agent and charge control agent have the number average primary particle size of about 10 to 500 nm in a state where they are dispersed in the toner.

The toner particle size of the invention is preferably 3 to 8 μm in a volume average particle size. This particle size can be controlled by the concentration of coagulant, the addition amount of organic solvent or a fusion time, further a composition of the polymer itself when the toner particles are formed by the polymerization.

By making the volume average particle size in the range of 3 to 8 μm, the toner fine particles with large adhesive force which adhere to a heating member by taking a flight and generate the off-set in a fixing step are reduced, and the image quality of half tone is improved and the image quality of thin lines and dots is improved by increasing a transfer efficiency.

[Measurement Condition]

(1) Aperture 100 μm (2) Sample preparation method: An appropriate amount of a surfactant (neutral detergent) is added to 50 to 100 ml of an electrolytic solution (ISOTON R-11 supplied from Coulter Scientific Japan), stirred. Then 10 to 20 mg of a measurement sample is added thereto. The sample is prepared by dispersing/treating this system using an ultrasonic dispersing machine for one minute.

The toner of the invention can further exert the effects by adding fine particles such as inorganic fine particles and organic fine particles as the external additives. As the reason for it, it is estimated that flasking and detachment of the external additives are effectively suppressed and thus the effects thereof are remarkably exhibited.

As these inorganic fine particles, inorganic oxide particles of silica, titanium, alumina and the like are preferable, and further it is preferred that hydrophobing treatment with a silane coupling agent, a titanium coupling agent and the like is given to these inorganic fine particles. A degree of the hydrophobing treatment is not especially limited, but those measured as methanol wettability of 40 to 95 are preferable. The methanol wettability is one where wettability for methanol is evaluated. In this method, 0.2 g of the inorganic fine particles subjected to the measurement is weighted and added to 50 ml of distilled water placed in a 200 ml content beaker. Methanol from a burette of which extremity is immersed in the liquid is slowly dripped with slowly stirring until whole inorganic fine particles are wetted. When the amount of this methanol required for wetting the whole inorganic fine particles is a (ml), a hydrophobing degree is calculated by the following formula.

$$\text{Hydrophobing degree}=(a/(a+50))\times 100$$

The addition amount of this external additive is from 0.1 to 5.0% and preferably from 0.5 to 4.0% by mass in the toner. As the external additive, various matters may be used in combination.

Image Forming Method

When the toner is used as the non-magnetic single component toner, a development unit having a structure where a developer layer regulating member for forming a thin layer is pressed to a developer layer supporter is used, and development is performed with contact or without contact. A contact development is a preferable mode.

When the toner is used as a double component developer, there is a mode where a developer made up of the toner of the invention and a carrier is prepared and the development is performed with or without contact. It is an extremely preferable aspect of the invention. The toner of the invention can be also suitably used for a toner recycle mode where untransferred toner remaining on the photoconductor is collected and returned to a development section.

As carriers which compose the two component developer, materials conventionally known in the art such as metals such as iron, ferrite and magnetite as magnetic particles, and alloys thereof with metals such as aluminium and lead can be used. Especially, ferrite particles are preferable. For the above magnetic particles, the volume average particle size thereof is from 15 to 100 μm and more preferably from 25 to 60 μm. The volume average particle size of the carrier can be measured by a laser diffraction type particle size distribution measurement apparatus comprising a wet type dispersing machine, "Helos" (supplied from Sympatec GmbH) as a representative. As the carrier, those further coated with a resin and so-called resin dispersion type carriers where magnetic particles are dispersed in the resin are preferable. A resin composition for coating is not especially limited, and for example, olefin type resins, styrene type resins, styrene/acryl type resins, silicone type resins, ester type resins, or fluorine-containing polymer type resins or the like are used. A resin for composing the resin dispersion type carrier is not especially limited, those known in the art can be used, and, for example, it is possible to use styrene-acryl resins, polyester resins, fluorine type resins, phenol resins and the like.

A suitable fixing method used for the invention can include a so-called contact heating mode. The contact heating mode can include a heat press fixing mode, further a heating roller fixing mode and a mode for fixing by a rotating heating member (e.g., belt) which encloses a fixedly disposed heating body.

The heating roller fixing mode is composed of a heating member that is a roller comprising a support and a fluorine containing layer formed on the support. Preferably, the heating roller fixing mode is composed of an upper roller having a heating source inside a metal cylinder composed of iron, aluminium and the like of which surface is coated with tetrafluoroethylene, polytetrafluoroethylene alkoxyvinylether copolymer or the like in many cases and a lower roller formed by silicone rubber or the like. As the heating source, those having a linear heater which heats the surface temperature of the upper roller to about 120 to 200° C. are representatives. At a fixing section, pressure is placed on betweenness of the upper roller and the lower roller and the lower roller is deformed to form a so-called nip. A nip width is from 1 to 10 mm and preferably from 1.5 to 7 mm. A fixing line speed is preferably from 40 mm/sec to 600 mm/sec. When the nip width is narrow, the heat is not imparted uniformly to the toner and uneven fixation occurs. Meanwhile, when the nip width is wide, a problem that melting of the resin is facilitated and fixing off-set become excessive occurs.

A mechanism of fixation cleaning may be provided and used. As this mode, it is possible to utilize a mode of supplying silicone oil to the upper roller or a film of fixation and a mode of cleaning by a pad, a roller, a web and the like where the silicone oil is impregnated.

Above fixing unit may be used by providing a cleaning mechanism thereto. As a cleaning mode, a mode where various silicone oils are supplied to films for the fixation and a mode of cleaning by a pad, a roller, a web and the like where the silicone oil is impregnated are used. As the silicone oil, it is possible to use polydimethylsiloxane, polymethylphenylsiloxane, polydiphenylsiloxane and the like. Furthermore, siloxane which contains fluorine can be also suitably used.

FIG. 1 is a sectional block diagram showing one example of the image forming apparatus of the invention. 4 is a photoconductor drum(image bearing member) which is a charged body, is made by forming an organic photo conductive body (OPC) which is a photoconductor layer on a peripheral face of a drum base substance made of aluminium, and rotates in an arrow direction at the given speed.

In FIG. 1, based on information read out at a document reading out unit which is not shown in the figure, exposure light is emitted from a semiconductor laser light source 1. An electrostatic latent image is made by allocating this by a polygon mirror 2 to a vertical direction for a paper face in FIG. 1 and radiating on a photoconductor face via fθ lens 3 which compensates distortion of the image. The photoconductor drum 4 has been precedently charged uniformly by a charging unit 5, and has started rotating in clockwise in conformity with a timing of picture exposure.

The electrostatic latent image on the photoconductor drum face is developed by a development unit 6, and transferred on transfer paper 8 fed in conformity with a timing by an action of a transfer unit 7. Further, the photoconductor drum 4 and the transfer paper 8 are separated by a separation unit (separation pole) 9, but a developed picture is supported on the transfer paper 8, led to a fixing unit (fixing device) 10 and fixed.

Untransferred toner and the like left on the photoconductor face are cleaned by a cleaning unit 11 of a cleaning blade mode, residual charge is eliminated at a pre-charging exposure light (PCL) 12, and it is uniformly charged again by the charging unit 5 for next image formation.

Next, the transfer paper is representatively plain paper, but is not especially limited so long as unfixed picture after the development can be transferred on it, and PET base for OHP and the like are of course included.

A rubber-like elastic body with a thickness of about 1 to 30 mm is used for the cleaning blade 13, and urethane rubber is most frequently used as quality of material. Since this is used in contacting the photoconductor with pressure, heat is easily conducted. In the invention, it is desirable that a cancellation mechanism is provided to separate it from the photoconductor when image forming operation is not performed.

The invention can be preferably used for an image forming apparatus by electrophotography, especially an apparatus for forming an electrostatic latent image on a photoconductor by modulation beams modulated with digital image data from a computer and the like.

Figure 2:
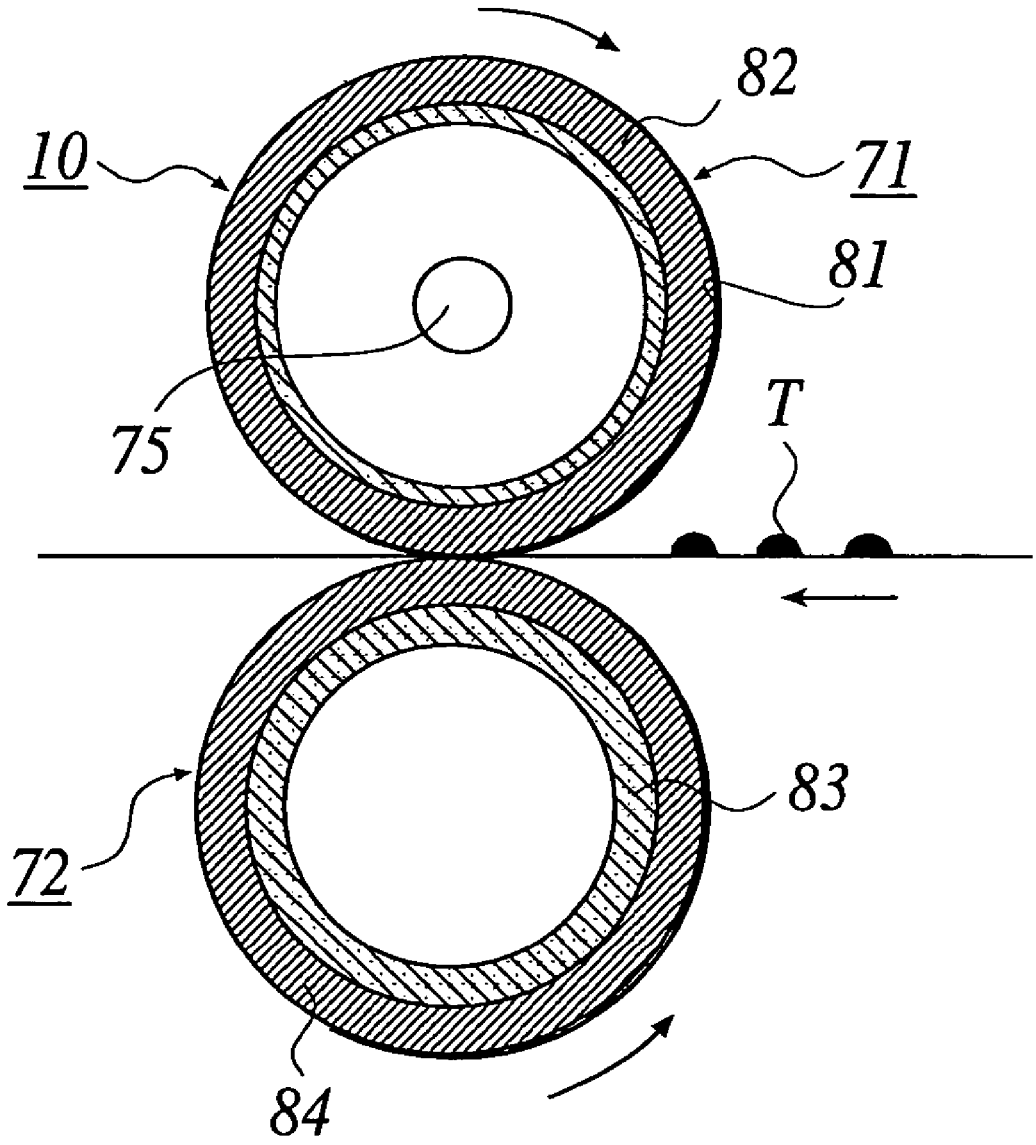
FIG. 2 is a sectional view showing one example of a fixing device applied in the invention.

FIG. 2 is a sectional view showing one example of a fixing device used in the image forming method using the toner of the invention. The fixing device shown in FIG. 2 comprises a heating roller 71 and a pressing roller 72 which abuts thereto. In FIG. 2, T is a toner image formed on transfer paper (image forming support).

The heating roller 71 is one in which a coating layer 82 made up of a fluorine resin or an elastic body is formed on the surface of a core grid 81, and encloses a heating member 75 made up of a linear heater.

The core grid 81 is made of a metal, and an internal diameter thereof is from 10 to 70 mm. Metals which compose the core grid 81 are not especially limited, and can include, for example, metals such as iron, aluminium and copper, or alloys thereof.

A wall thickness of the core grid 81 is from 0.1 to 15 mm, and is determined in consideration of a balance between request of saving energy (making thin) and strength (depending on configuring materials). For example, when the core grid made up of aluminium retains as the same strength as that of iron with a wall thickness of 0.57 mm, the wall thickness thereof is required to be 0.8 mm.

As the heating member 75, a halogen heater can be suitably used. The pressing roller 72 is one in which a coating layer 84 made up of an elastic body is formed on the surface on a core grid 83. Elastic bodies which compose the coating layer 84 are not especially limited, and can include various soft rubbers such as urethane rubber and silicone rubber, and sponge rubber. As those which compose the coating layer 84, it is preferable to use silicone rubber and silicone sponge rubber exemplified.

Asker C hardness of the elastic body which composes the coating layer 84 is less than 80°, preferably less than 70° and more preferably less than 60°.

A thickness of the coating layer 84 is from 0.1 to 30 mm and preferably from 0.1 to 20 mm.

An abutting load (total load) between the heating roller 71 and the pressing roller 72 is typically from 40 to 350 N, preferably from 50 to 300 N and more preferably from 50 to 250 N. This abutting load is defined in consideration of strength of the heating roller 71 (wall thickness of core grid 81), and for example, in the heating roller having the core grid made up of iron of 0.3 mm, it is preferable to be 250 N or less.

EXAMPLES

Next, representative aspects of the invention are described as examples, but of course the invention is not limited thereto. "Parts" in the text represent "parts by mass".

Coloring Agent Pretreatment Example 1

REGAL 330R (supplied from Cahot Corporation) of carbon black was treated with heat at 200° C. in a nitrogen gas flow. The black pigments 1 to 4 shown below were prepared by changing a time of treatment.

TABLE 1

| BLACK PIGMENT NUMBER | CONTENT OF AROMATIC AMINE (ppm) | TIME OF TREATMENT (hour) |
|---|---|---|
| 1 | 560 | 0 |
| 2 | 110 | 1 |
| 3 | 54 | 3 |
| 4 | 3 | 10 |

A content of aromatic amine was measured by headspace gas chromatography.

Coloring Agent Pretreatment Example 2

Pigment yellow 74 was treated at 150° C. under reduced pressure at 133 Pa using a vacuum dryer. The yellow (Y) pigments 1 to 4 shown below were prepared by changing a time of treatment. Aromatic amine was o-anisidine.

TABLE 2

| YELLOW PIGMENT NUMBER | CONTENT OF AROMATIC AMINE (ppm) | TIME OF TREATMENT (hour) |
|---|---|---|
| 1 | 510 | 0 |
| 2 | 95 | 1 |
| 3 | 51 | 2 |
| 4 | 2 | 10 |

Coloring Agent Pretreatment Example 3

100 Parts of pigment yellow 74 and 100 Parts of styrene/acryl resin were added and kneaded by two rollers to yield a master batch-treated yellow pigment. The following yellow (Y) pigments 5 and 6 were obtained by changing a time of kneading. Aromatic amine was o-anisidine.

TABLE 3

| YELLOW PIGMENT NUMBER | CONTENT OF AROMATIC AMINE (ppm) | TIME OF KNEADING (min) |
|---|---|---|
| 5 | 51 | 5 |
| 6 | 3 | 10 |

Latex Preparation Example

A solution where 7.08 g of anionic surfactant (sodium dodecylbenzenesulfonate: SDS) is precedently dissolved in ion-exchange water (2760 g) is placed in a separable flask of 5000 ml equipped with a stirring unit, a thermal sensor, a cooling tube and a nitrogen introducing unit. An internal temperature was raised to 80° C. with stirring at a stirring speed of 230 rpm under a nitrogen gas flow. Meanwhile, a polymerizable monomer made up of 115.1 g of styrene, 42.0 g of n-butyl acrylate and 10.9 g of methacrylic acid was added to 72.0 g of the illustrated compound 19), and heated to 80° C. to make a polymerizable monomer solution. Here, the above heated solution was mixed and dispersed into the previous surfactant solution by a mechanical dispersing machine having a circulation path to make emulsion particles having uniform dispersion particle size.

Then, a solution where 0.84 g of a polymerization initiator (potassium persulfate: KPS) was dissolved in 200 ml of ion-exchange water was added and heated/stirred at 80° C. for one hour. A polymerization conversion rate at this time point was 94%. Then, a solution where 0.42 g of KPS was dissolved in 100 ml of ion-exchange water was dripped and heated/stirred for two hours to make latex particles.

Subsequently, a solution where 8.00 g of KPS was dissolved in 240 ml of ion-exchange water was added, after 15 min, a mix solution made of 383.6 g of styrene, 140.0 g of n-butyl acrylate, 36.4 g of methacrylic acid and 13.7 g of n-octyl-1-mercaptopropionate ester was dripped over 126 min at 80° C. After the completion of dripping, the solution is kept with heated/stirred for two hours. Thereafter, the temperature was cooled to 40° C. to yield latex particles. This latex particle is rendered the latex 1.

Coloring Particle Manufacture Example 1

Sodium n-dodecylsulfate (9.2 g) is dissolved in 160 ml of ion-exchange water with stirring. Each 30 g of the above pigments (black pigments 1 to 4, yellow pigments 1 to 4) was gradually added to this solution, respectively under stirring, and then dispersed using Clearmix. As a result of measuring particle sizes in the above dispersion solution using an electrophoretic light scattering spectrophotometer, "ELS-800" supplied from Otsuka Electronics Co., Ltd., a weight average particle size was 112 nm. This dispersion solution is rendered a "coloring agent dispersion solution".

The aforementioned "latex 1" (1250 g), 2000 ml of ion-exchange water and the "coloring agent dispersion solution" are placed and stirred in a 5 liter four-necked flask equipped with a thermal sensor, a cooling tube, a nitrogen introducing unit and a stirring unit. After the solution is adjusted to 30° C., an aqueous solution of sodium hydroxide at 5 mol/liter was added to this solution to adjust pH to 10.0. Then, an aqueous solution where 52.6 g of magnesium chloride 6-hydrate was dissolved in 72 ml of ion-exchange water was added at 30° C. over 10 min under stirring.

Thereafter, afrer lair for 3 mm remperature rising is stared, and rhe temperature is raised up to 90° C. of solution temperature over 6 mm (temperature rising rate=10° C. /min). At that stare, particle sizes were measured by COULTER COUNTER TA-II, and at the time point when a volume average particle size became 6.5 μm, an aqueous solution where 115 g of sodium chloride was dissolved in 700 ml of ion exchange water was added to stop particle growth.

At the solution temperature of 90° C.±2° C., heating/stirring was further continued for 6 hours to salt out/fuse. Subsequently, the solution was cooled to 30° C. at a condition of 6° C./min, hydrochloric acid was added to adjust pH to 2.0, and the stirring was stopped. Produced coloring particles were filtrated, repeatedly washed with ion-exchange water, and then dried with warm wind at 40° C. to yield the coloring particles. With respect to the respective pigments (black pigments 1 to 4, yellow pigments 1 to 4), the coloring particles were obtained as described above. These coloring particles are shown in Table 4 with their aromatic amine content.

TABLE 4

| COLORING PARTICLE | PIGMENT NUMBER | CONTENT OF AROMATIC AMINE (ppm) |
|---|---|---|
| COLORING PARTICLE 1 | BLACK PIGMENT 1 | 62 |
| COLORING PARTICLE 2 | BLACK PIGMENT 2 | 12 |
| COLORING PARTICLE 3 | BLACK PIGMENT 3 | 6 |
| COLORING PARTICLE 4 | BLACK PIGMENT 4 | 0.3 |
| COLORING PARTICLE 5 | YELLOW PIGMENT 1 | 56 |
| COLORING PARTICLE 6 | YELLOW PIGMENT 2 | 11 |
| COLORING PARTICLE 7 | YELLOW PIGMENT 3 | 6 |
| COLORING PARTICLE 8 | YELLOW PIGMENT 4 | 0.2 |

Coloring Particle Manufacture Example 2 (Example of Suspension Polymerization)

To a four-necked flask equipped with a high speed mixing unit (TK homomixer), 710 parts by mass of ion-exchange water and 450 parts by mass of an aqueous solution of disodium phosphate at 0.1 ml/liter were added and heated at 65° C., and under a stirring condition of rotational frequency at 12000 rpm, 68 parts by mass of an aqueous solution of calcium chloride at 1.0 mol/liter was gradually added to prepare an aqueous dispersion vehicle comprising a dispersion solution comprising colloidal tricalcium phosphate. Then, 30 parts by mass of the illustrated compound (19) was added to a dispersion solution where 26.4 parts by mass of the above each pigment was added to and dispersed in 165 parts by mass of styrene, 35 parts by mass of n-butyl acrylate using a sand grinder, and dissolved at 80° C. Then, a solution where 2 parts by mass of tert-dodecyl mercaptan and 10 parts by mass of 2,2'-azobis(2,4-dimethylvaleronitrile) as a polymerization initiator was gradually added to the above aqueous dispersion vehicle under the stirring condition of rotational frequency at 12000 rpm to disperse a solution comprising a polymerizable monomer in water. Then, polymerization reaction was performed for 10 hours at 65° C. under the stirring condition of 200 rpm under nitrogen gas flow. At the completion of the polymerization reaction, hydrochloric acid was added to eliminate tricalcium phosphate which was a dispersion stabilizer was eliminated, and the filtration was performed. Then, particles were washed with ion-exchange water and dried with warm wind at 40° C. to yield coloring particles. With respect to the respective pigments (black pigments 1 to 4, yellow pigments 1 to 6), the coloring particles were obtained as described above. These coloring particles are shown in Table 4 with their aromatic amine content.

TABLE 5

| COLORING PARTICLE | PIGMENT NUMBER | CONTENT OF AROMATIC AMINE (ppm) |
|---|---|---|
| COLORING PARTICLE 9 | BLACK PIGMENT 1 | 62 |
| COLORING PARTICLE 10 | BLACK PIGMENT 2 | 12 |
| COLORING PARTICLE 11 | BLACK PIGMENT 3 | 6 |
| COLORING PARTICLE 12 | BLACK PIGMENT 4 | 0.3 |
| COLORING PARTICLE 13 | YELLOW PIGMENT 1 | 56 |
| COLORING PARTICLE 14 | YELLOW PIGMENT 2 | 11 |
| COLORING PARTICLE 15 | YELLOW PIGMENT 3 | 6 |
| COLORING PARTICLE 16 | YELLOW PIGMENT 4 | 0.2 |
| COLORING PARTICLE 17 | YELLOW PIGMENT 5 | 6 |
| COLORING PARTICLE 18 | YELLOW PIGMENT 6 | 0.3 |

Then, 1% by mass of hydrophobic silica (number average primary particle size=12 nm, hydrophobing degree=68) and hydrophobic titanium oxide (number average primary particle size=20 m, hydrophobing degree=63) were added to the above "coloring particles 1" to "coloring particles 18, respectively, and mixed by Henschel mixer to obtain toners. These are rendered the "toner 1" to "toner 18.

With respect to physical properties such as shapes and particle sizes, there is no difference even when either the coloring particle or the toner is measured.

The image forming apparatus shown in FIG. 1 was used for evaluation tests, and the heat fixing unit with same configuration as that shown in FIG. 2 was used. Specifically, it has cylindrical aluminium alloy with a thickness of 1.0 mm housing a heater in a midmost, where an internal diameter is 35 mm and a total width is 310 mm, of which surface is coated with a tube of PFA (tetrafluoroethylene-perfluoroalkylvinylether copolymer) (thickness: 120 μm) as a heating roller (upper roller) and has a pressing roller (lower roller) having a core grid with an internal diameter of 40 mm and a wall thickness of 2.0 mm of which surface is similarly composed of sponge-like silicone rubber (Asker C hardness=48, thickness: 2 mm). A nip width was 5.8 mm. Using this fixing unit, a line speed of printing is set to 180 mm/sec. The temperature at fixation was controlled by surface temperature of the upper roller, and a set temperature was 170° C. A web where a small amount of silicone oil was impregnated was used as a cleaning mechanism of the fixing unit.

Using this fixing unit, 1000 sheets of a half tone image with a pixel rate of 15% were continuously printed, and printing took a pause for one hour. After the pause, 0.2 million sheets of white paper were printed to perform a work for evaluating the presence or absence of stain delivery from the fixing unit. The presence or absence of fixing stain was visually judged, and evaluated by the following criteria. Numbers of printed sheets up to the level C for the stain delivery were recorded.

Level A: No stain delivery, and no stain both on upper and lower rollers

Level B: No stain delivery, but adhesion of toner on lower roller

Level C: Slight stain delivery, and much adhesion of toner on lower roller

Level D: Intensive stain delivery, and much adhesion of toner on lower roller

The results are shown in the following Table 6.

TABLE 6

| | TONER NUMBER | JETTING LEVEL AFTER PRINTING 0.2 MILLION SHEETS | NUMBER OF SHEETS UP TO LEVEL C |
|---|---|---|---|
| EXAMPLE 1 | TONER 2 | LEVEL B | NO SHEET |
| EXAMPLE 2 | TONER 3 | LEVEL A | NO SHEET |
| EXAMPLE 3 | TONER 4 | LEVEL A | NO SHEET |
| EXAMPLE 4 | TONER 6 | LEVEL B | NO SHEET |
| EXAMPLE 5 | TONER 7 | LEVEL A | NO SHEET |
| EXAMPLE 6 | TONER 8 | LEVEL A | NO SHEET |
| EXAMPLE 7 | TONER 10 | LEVEL B | NO SHEET |
| EXAMPLE 8 | TONER 11 | LEVEL A | NO SHEET |
| EXAMPLE 9 | TONER 12 | LEVEL A | NO SHEET |
| EXAMPLE 10 | TONER 14 | LEVEL B | NO SHEET |
| EXAMPLE 11 | TONER 15 | LEVEL A | NO SHEET |
| EXAMPLE 12 | TONER 16 | LEVEL A | NO SHEET |
| EXAMPLE 13 | TONER 17 | LEVEL A | NO SHEET |
| EXAMPLE 14 | TONER 18 | LEVEL A | NO SHEET |
| COMPARATIVE EXAMPLE 1 | TONER 1 | LEVEL D | 55,000 SHEETS |
| COMPARATIVE EXAMPLE 2 | TONER 5 | LEVEL D | 62,000 SHEETS |
| COMPARATIVE EXAMPLE 3 | TONER 9 | LEVEL D | 59,000 SHEETS |
| COMPARATIVE EXAMPLE 4 | TONER 13 | LEVEL D | 63,000 SHEETS |

As is obvious from Table 6, it is shown that the properties are good in the examples 1 to 14 within the invention whereas there is apparently problematic in the comparative examples 1 to 4 out of the invention.

The entire disclosure of JP Tokugan-2001-279513 filed on Sep. 14, 2001 including specification, claims, drawings and summary is incorporated herein by reference in its entirety.

What is claimed is:

1. A toner for electrostatic latent image development comprising a coloring agent and a resin, wherein the toner is a yellow toner formed by a polymerization method and the yellow toner includes o-anisidine in an amount of 50 ppm or less, and the yellow toner has a volume average particle size of 3 to 8 μm, the coloring agent is C.I. pigment yellow 74.

2. The toner of claim 1, which is formed by polymerization of a radical-polymerizable monomer in aqueous vehicle.

3. The toner of claim 2, wherein the amount of o-anisidine is 30 ppm or less.

4. The toner of claim 1, which is formed by fusing resin particles formed from radical-polymerizable monomer and particles of a coloring material in aqueous vehicle.

5. The toner of claim 4, wherein the amount of o-anisidine is 30 ppm or less.

6. The toner of claim 1, wherein the resin comprises both a high molecular weight component having a peak or a shoulder at the range of 100,000 to 1,000,000 and a low molecular weight component having a peak or a shoulder at the range of 1,000 to less than 20,000.

7. The toner of claim 1, wherein the resin has a glass transition point of 20 to 90° C. and a softening point of 80 to 220° C.

8. The toner of claim 1, wherein the amount of o-anisidine is 30 ppm or less.

9. The toner of claim 1, wherein the amount of o-anisidine is 10 ppm or less.

10. An image forming method comprising:

developing an electrostatic latent image formed on an image bearing member by the toner of claim 1;

transferring a toner image formed on the image bearing member onto a recording material; and fixing the transferred toner image to the recording material.

11. The method of claim 10, wherein the fixing comprises transmitting the recording material between a heating member and a pressing member.

12. The method of claim 11, wherein the heating member or the pressing member is a roller.

13. The method of claim 12, wherein the heating member is the roller which comprises a support and a fluorine containing layer formed on the support.

14. The method of claim 10, wherein the toner is formed by polymerization of a radical-polymerizable monomer in aqueous vehicle.

15. The method of claim 14, wherein the content of o-anisidine is 30 ppm or less.

16. The method of claim 10, wherein the toner is formed by fusing resin particles formed from radical-polymerizable monomer and particles of a coloring material in aqueous vehicle.

17. The method of claim 16, wherein the content of o-anisidine is 30 ppm or less.

18. A toner for electrostatic latent image development comprising a coloring agent and a resin, wherein the toner is a yellow toner formed by polymerization of radical-polymerizable monomer in aqueous vehicle and a content of o-anisidine contained in the yellow toner is 50 ppm or less, the coloring agent is C.I. pigment yellow 74.

* * * * *